US007318248B1

(12) United States Patent
Yan

(10) Patent No.: US 7,318,248 B1
(45) Date of Patent: Jan. 15, 2008

(54) CLEANER HAVING STRUCTURES FOR JUMPING OBSTACLES

(76) Inventor: Jason Yan, No. 8, Lane 108, Ya Chou Road, Tu Cheng, Taipei County (TW) 236

( * ) Notice: Subject to any disclaimer, the term of this patent is extended or adjusted under 35 U.S.C. 154(b) by 0 days.

(21) Appl. No.: 11/595,945

(22) Filed: Nov. 13, 2006

(51) Int. Cl.
*A47L 5/00* (2006.01)

(52) U.S. Cl. ..... 15/319; 15/340.1; 701/23

(58) Field of Classification Search ..... None
See application file for complete search history.

(56) References Cited

U.S. PATENT DOCUMENTS 5,815,880 A * 10/1998 Nakanishi ..... 15/319

6,553,612 B1 * 4/2003 Dyson et al. ..... 15/340.1

* cited by examiner

*Primary Examiner*—David Redding
(74) *Attorney, Agent, or Firm*—Bacon & Thomas, PLLC

(57) ABSTRACT

A cleaner having structures for jumping obstacles is provided. A lower portion of a main body of the cleaner is disposed with a movable chassis, and the center of the chassis is formed with a hollow post that is to be inserted in a sleeve of the main body of the cleaner and is hooked by a hook element. The hollow post and the sleeve are moveable with each other, such that the hollow post can move up and down in the sleeve freely. A movable dustpan board is mounted on a front periphery of the chassis by long posts and springs.

2 Claims, 7 Drawing Sheets

CLEANER HAVING STRUCTURES FOR JUMPING OBSTACLES

FIELD OF THE INVENTION

The present invention relates to a cleaner, and more particularly to a cleaner having structures for jumping obstacles.

BACKGROUND OF THE INVENTION

A conventional cleaner is shown in FIG. 1, a bottom of a main body 1 of the cleaner is flat and fixed, and is only about 0.3-0.5 centimeters high from the ground. When the ground is flat and has no obstacles, the cleaner can move normally. Once the main body 1 of the cleaner encounters a bigger obstacle such as a pencil or small nail, the main body 1 of the cleaner will be blocked and cannot move.

The present invention has arisen to mitigate and/or obviate the afore-described disadvantages.

SUMMARY OF THE INVENTION

The primary objective of the present invention is to provide a cleaner having structures for jumping obstacles, wherein a lower portion of the main body of the cleaner is disposed with a movable chassis, and a center of the chassis is formed with a hollow post that is to be inserted in a sleeve of the main body of the cleaner and is hooked by a hook element. The hollow post and the sleeve are moveable with each other, such that the hollow post can move up and down in the sleeve freely. A movable dustpan board is mounted on a front periphery of the chassis by long posts and springs.

When the main body of the cleaner encounters ordinary dust or wastes, the dustpan board and the chassis will not be influenced. Once the main body of the cleaner encounters a bigger obstacle, the chassis will rise, and the dustpan board will be bent backward; after surmounting the obstacle, the dustpan board and the chassis will return to the original positions.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENT

Figure 1:
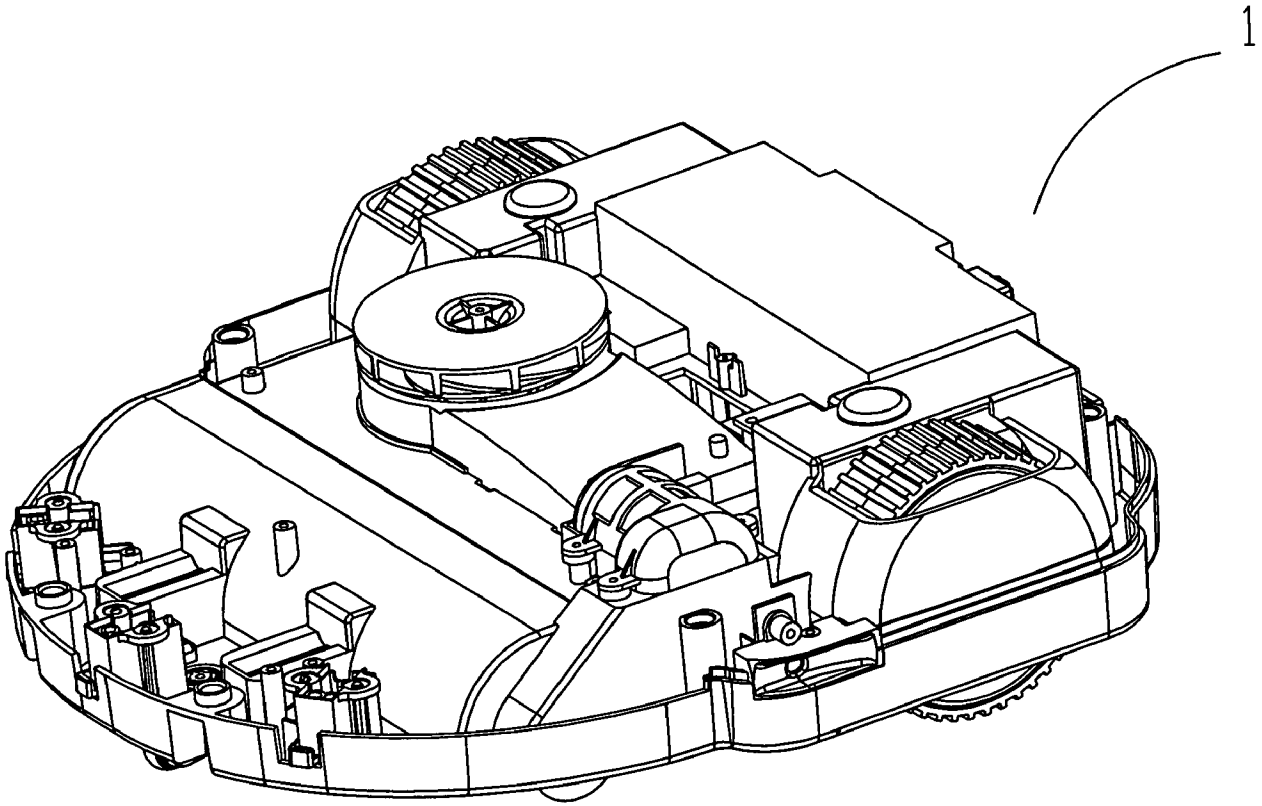
Fig. 1 (prior art)
FIG. 1 is a perspective view of a conventional cleaner.
Figure 2:
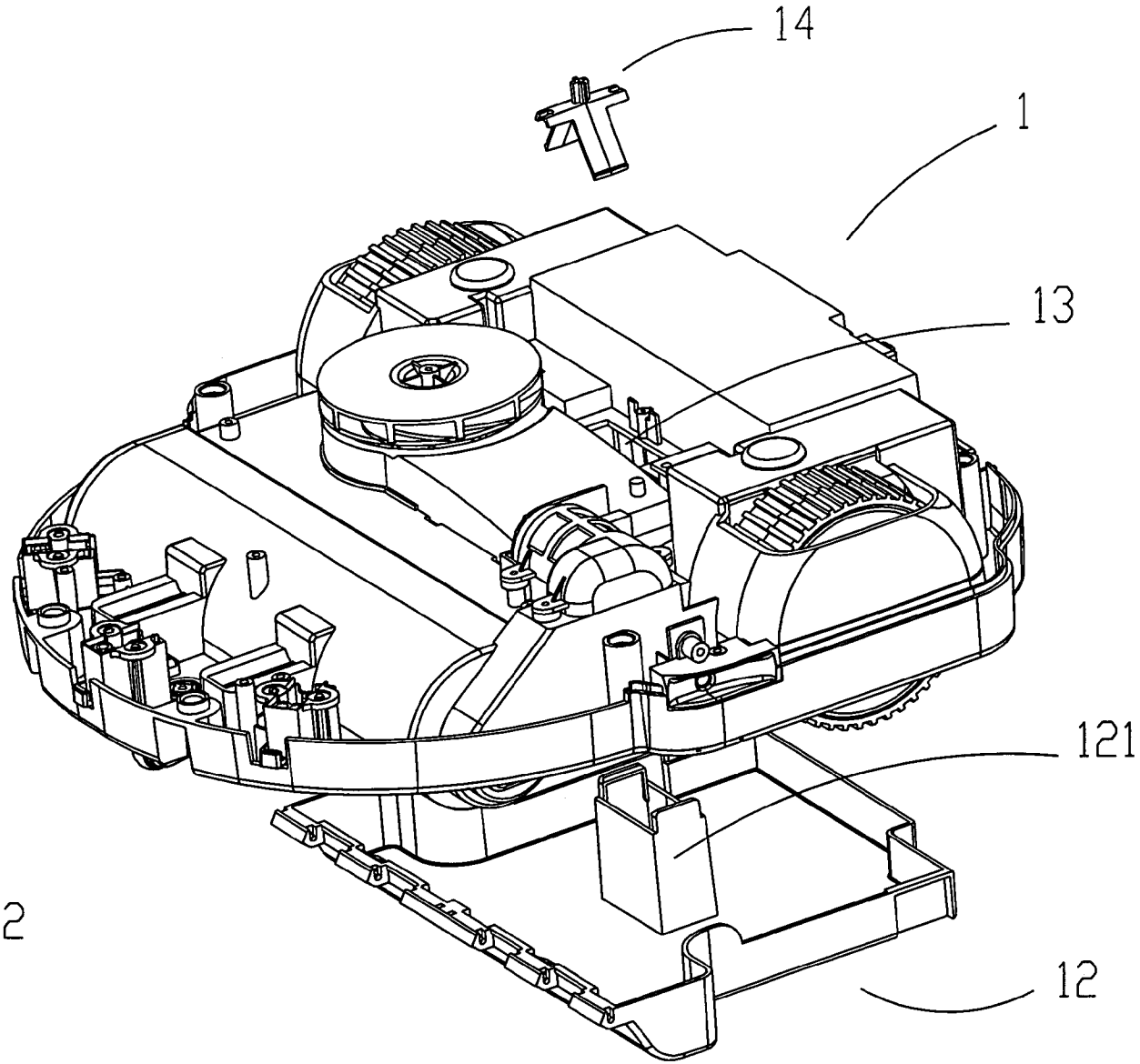
FIG. 2 is a perspective view of a cleaner having structures for jumping obstacles in accordance with the present invention.

Referring to FIG. 2, a cleaner having structures for jumping obstacles in accordance with the present invention is shown, a lower portion of a main body 1 of the cleaner is disposed with a movable dust collecting chassis 12, and the center of the chassis 12 is formed with a hollow post 121 that is to be inserted in a sleeve 13 of the main body 1 of the cleaner and is hooked by a hook element 14. The hollow post 121 and the sleeve 13 are moveable with each other, such that the hollow post 121 can move up and down in the sleeve 13 freely. The chassis 12 usually falls to the lowest position which is about 0.3-0.5 centimeters high from the ground.

Figure 3:
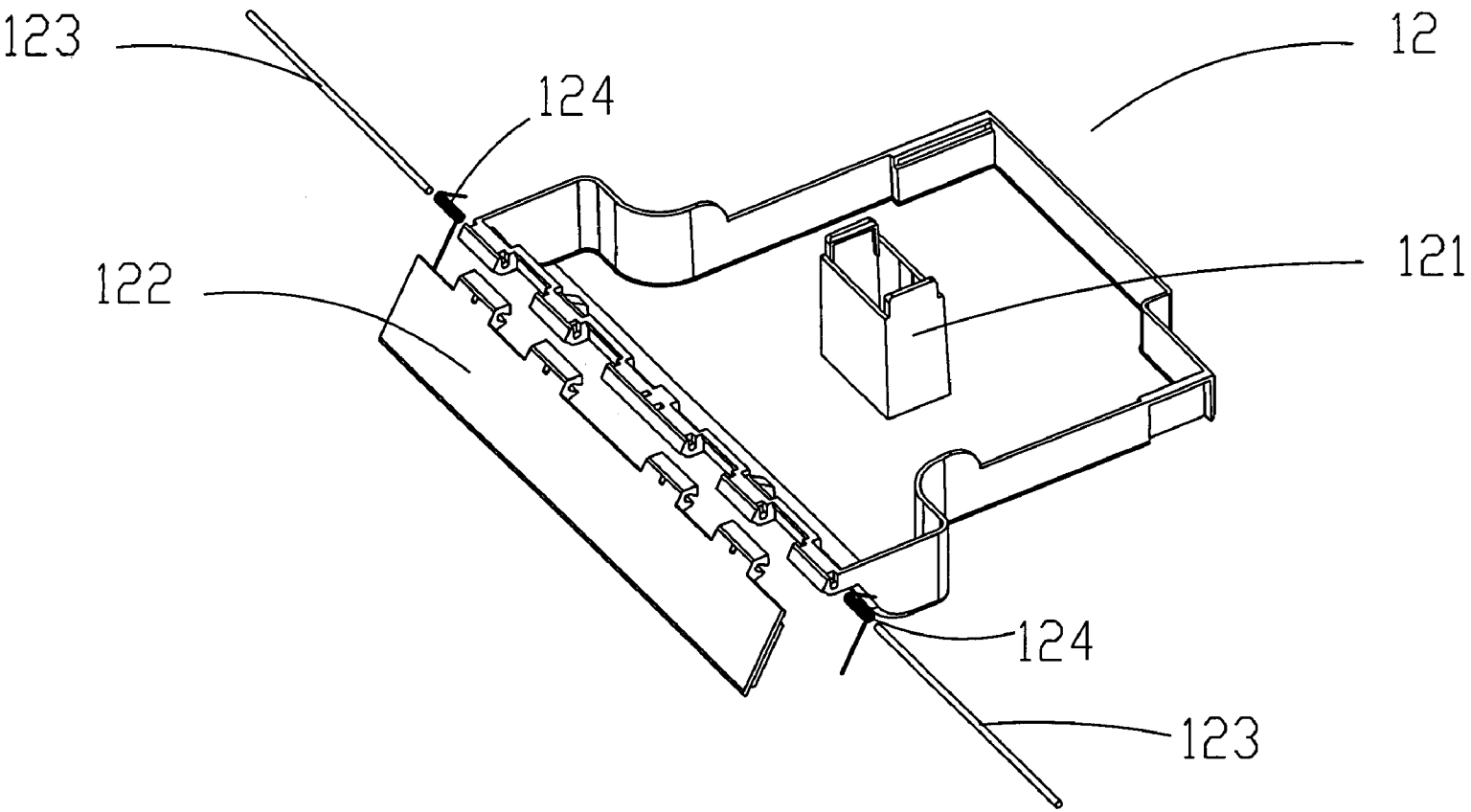
FIG. 3 is a perspective view showing the chassis in accordance with the present invention.

The structure of a front periphery of the chassis 12 is shown in FIG. 3, which is disposed with a dustpan board 122 for sweeping the dust and wastes, and the dustpan board 122 is mounted on the front periphery of the chassis 12 by two long posts 123 and two springs 124. The dustpan board 122 is inclined forward, and its front periphery extends downward to the ground for sweeping the dust and wastes to the main body 1 of the cleaner.

Figure 4:
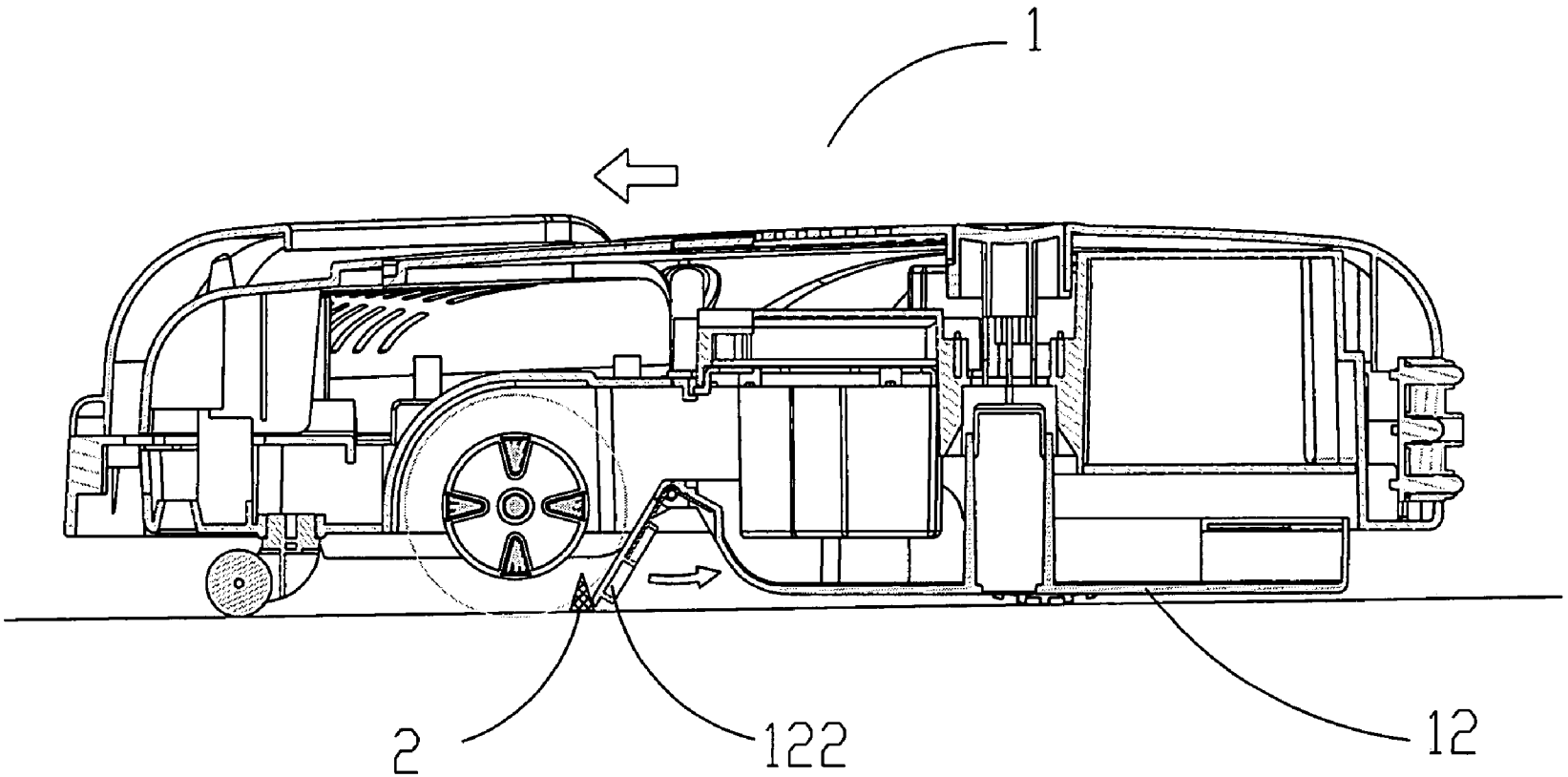
FIG. 4 is a schematic view showing the cleaner encounters a bigger obstacle.
Figure 5:
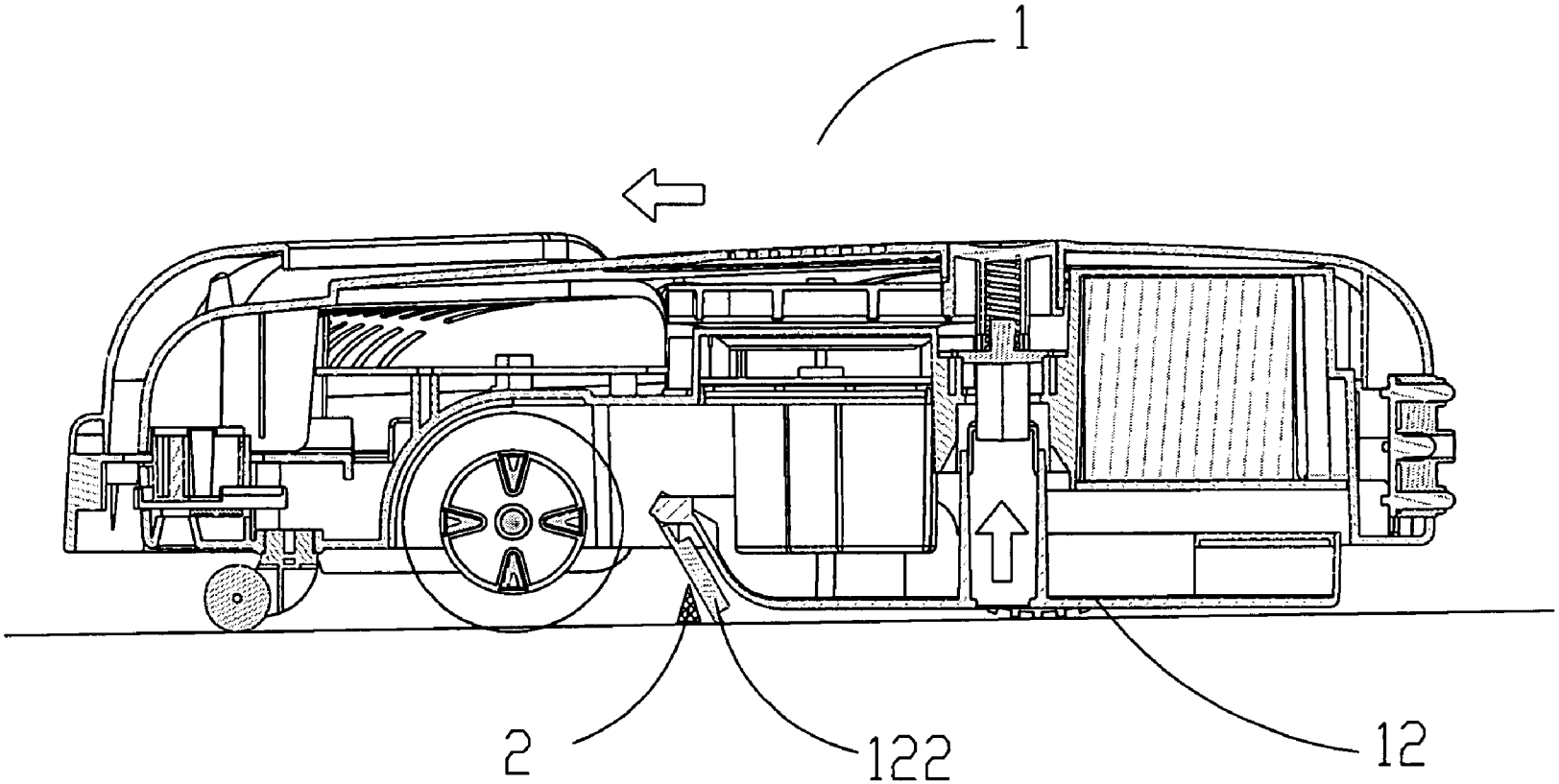
FIG. 5 is a schematic view showing that the dustpan board is bent backward.
Figure 6:
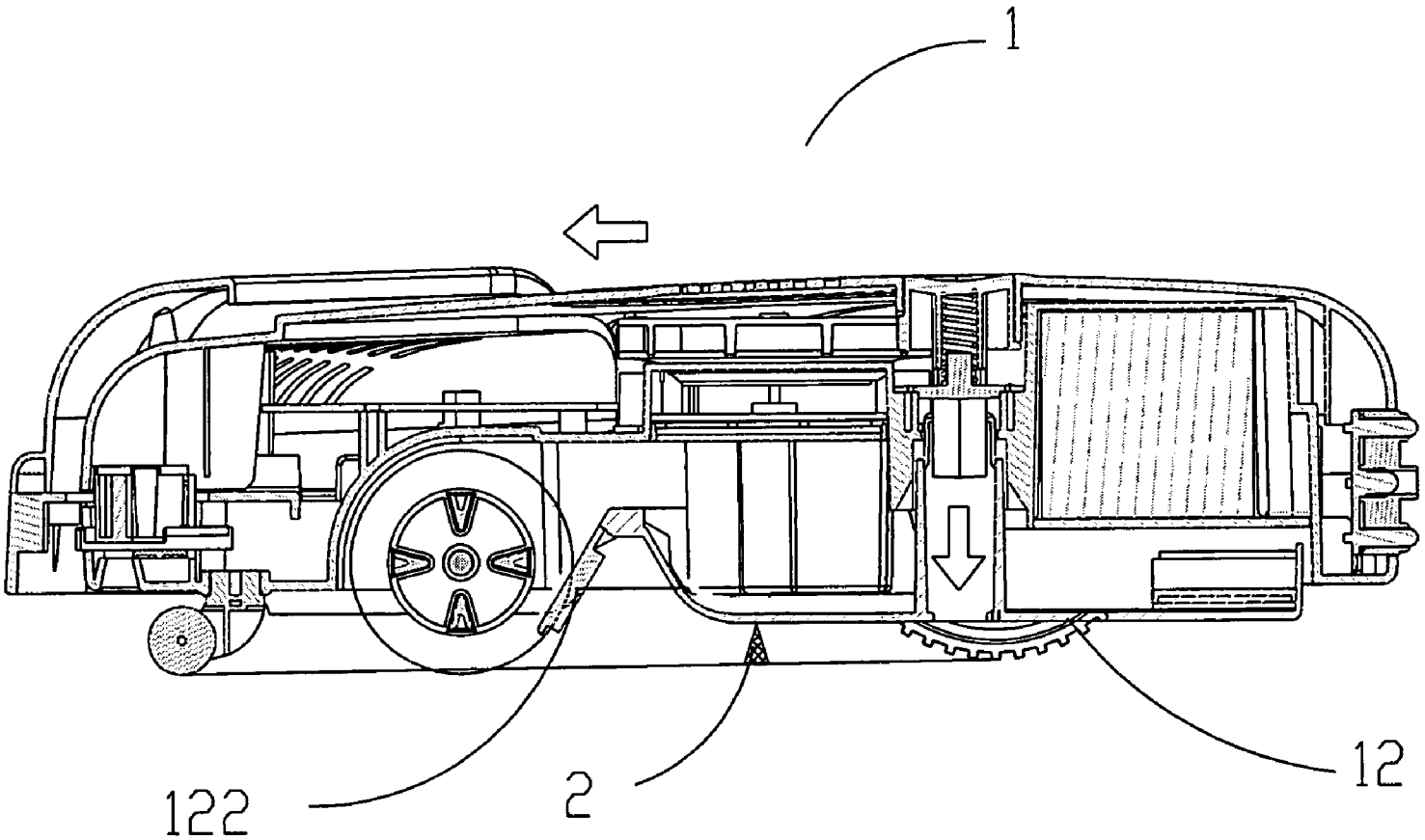
FIG. 6 is a schematic view showing that the dustpan board is returned to the original position after surmounting the obstacle.
Figure 7:
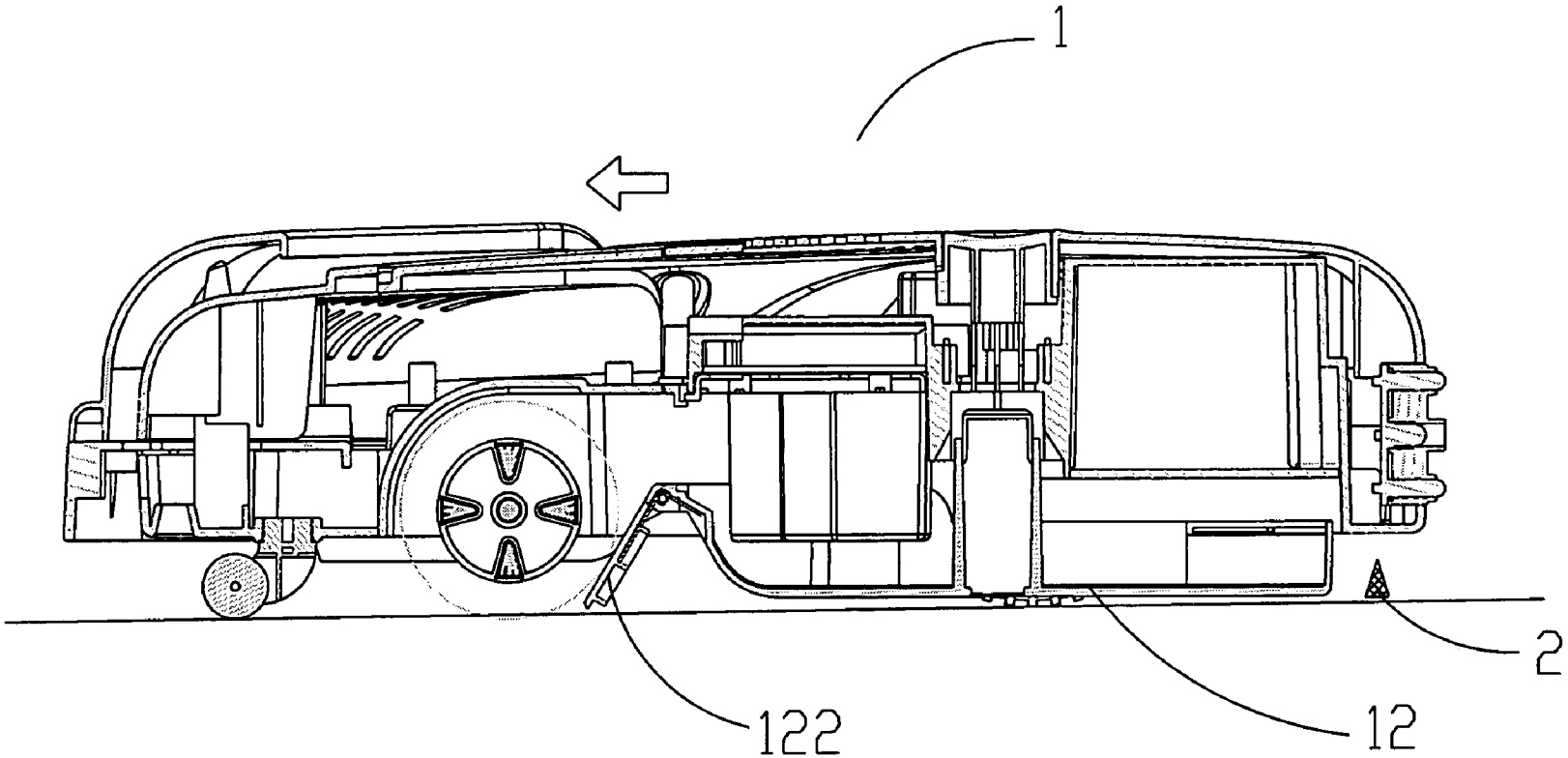
FIG. 7 is a schematic view showing the chassis returned to the lowest position after surmounting the obstacle.

When the main body 1 of the cleaner encounters ordinary dust or wastes, the dustpan board 122 and the chassis 12 will not be influenced, the dustpan board 122 will maintain its condition of inclining forward, and the chassis 12 will maintain its condition of falling to the lowest position. Referring to FIG. 4, once the main body 1 of the cleaner encounters a bigger obstacle 2 such as a pencil or small nail, the dustpan board 122 and the chassis 12 will be subjected to a blocking force, the hollow post 121 will rise in the sleeve 13, such that the chassis 12 will rise, and the dustpan board 122 will be bent backward by pressing the springs 124, as shown in FIG. 5. After surmounting the obstacle 2, the dustpan board 122 will be pushed back to its original position by the springs 124, as shown in FIG. 6. When the chassis 12 surmounts the obstacle 2, the chassis 12 will fall and return to the lowest position, as shown in FIG. 7.

While we have shown and described various embodiments in accordance with the present invention, it should be clear to those skilled in the art that further embodiments may be made without departing from the scope of the present invention.

What is claimed is:

1. A cleaner having structures for jumping obstacles, a lower portion of a main body of the cleaner being disposed with a movable dust collecting chassis, a center of the chassis being formed with a hollow post to be inserted in a sleeve of the main body of the cleaner and being hooked by a hook element; the hollow post and the sleeve being moveable with each other, such that the hollow post being allowed to be moved up and down in the sleeve freely.

2. The cleaner having structures for jumping obstacles as claimed in claim 1, wherein a movable dustpan board is mounted on a front periphery of the chassis by elongated posts and springs.

* * * * *